US007158731B2

(12) United States Patent
Takuma et al.

(10) Patent No.: US 7,158,731 B2
(45) Date of Patent: Jan. 2, 2007

(54) IMAGE FORMING APPARATUS WITH TONER CONCENTRATION CONTROLLER

(75) Inventors: Yasuo Takuma, Ibaraki (JP); Kaoru Kataoka, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 45 days.

(21) Appl. No.: 10/916,601

(22) Filed: Aug. 12, 2004

(65) Prior Publication Data

US 2005/0053386 A1 Mar. 10, 2005

(30) Foreign Application Priority Data

Sep. 5, 2003 (JP) ..... P2003-314016

(51) Int. Cl.
*G03G 15/08* (2006.01)

(52) U.S. Cl. ..... 399/27; 399/30

(58) Field of Classification Search ..... 399/27, 399/30, 58, 61, 62, 258
See application file for complete search history.

(56) References Cited

U.S. PATENT DOCUMENTS

2002/0025178 A1* 2/2002 Suzuki ..... 399/30

FOREIGN PATENT DOCUMENTS

JP 11-52700 2/1999

* cited by examiner

*Primary Examiner*—Sophia S. Chen
(74) *Attorney, Agent, or Firm*—McGinn IP Law Group,PLLC

(57) ABSTRACT

An image forming apparatus includes a toner concentration detector for detecting the toner concentration within a two-component developing unit, a toner supply unit for supplying a toner into the developing unit, a storage unit for sequentially holding and updating a history of a toner supply operation for a certain period of time, and a toner concentration control unit for determining the time of the toner supply operation by the toner supply unit, based on information stored in the storage unit and a difference between an output value of the toner concentration detector and a reference value, and maintaining the toner concentration constant.

19 Claims, 4 Drawing Sheets

IMAGE FORMING APPARATUS WITH TONER CONCENTRATION CONTROLLER

BACKGROUND OF THE INVENTION

1. Field of the Invention

The present invention relates to an image forming apparatus having a two-component developing unit and a toner concentration control unit.

2. Description of the Related Art

In the image forming apparatuses such as an electrophotographic printer and a copier in which an electrostatic latent image is visualized employing a two-component developer composed of toner and carrier, when the mixture ratio of toner and carrier or the toner concentration is not adequate within a developing unit for developing the electrostatic latent image with toner, a problem arises that the image density is so thin as to cause a carrier over, or the image density is so high as to increase the fogging. Thus, a toner concentration sensor is provided within the developing unit, and a toner supply apparatus for supplying the toner into the developing unit is controlled to keep the toner concentration constant. For example, as the printing density that is the ratio of image area to printing area is higher, a greater amount of toner is consumed and the toner concentration is lower. In this case, more toner must be supplied according to a decreased amount of toner concentration. A control method therefor involves dividing a deviation amount from a reference toner concentration into several levels, and increasing the supply amount of toner as the sensor value indicates the high level of deviation amount (e.g., refer to JP-A-11-52700).

With this control method, when the image is continuously printed at high printing density, the toner concentration is decreased to a level at which the toner supply amount is above the toner consumption amount, and then begins to increase. However, when the toner concentration is increased, the level is changed, and the toner supply amount is decreased. Again, the toner concentration is decreased and increased repeatedly, and finally stabilized at the level considerably lower than the reference toner concentration.

To solve this problem, in the prior art, when a low level of the toner concentration is continued, the supply amount of toner is increased above the amount of toner usually supplied at that level.

SUMMARY OF THE INVENTION

However, in the prior art, there are some problems that the low level of the toner concentration is continued until the supply amount of toner is increased above the normal amount, and a complicate control table must be prepared. Moreover, because the toner concentration sensor employs a wider output range for the control, the variable range of the toner concentration is increased.

It is an object of the invention to solve the above-mentioned problems and provide an image forming apparatus comprising a toner concentration control for providing the toner concentration more stably.

To accomplish the above object, this invention provides an image forming apparatus comprising toner concentration detecting means for detecting the toner concentration within a two-component developing unit, toner supply means for supplying a toner into the developing unit, storage means for sequentially holding and updating a history of a toner supply operation for a certain period of time, and toner concentration control means for determining the time of the toner supply operation by the toner supply means, based on information stored in the storage means and a difference between an output value of the toner concentration detecting means and a reference value, and maintaining the toner concentration constant.

Also, this invention provides the image forming apparatus, characterized in that the time for which the history of the toner supply operation is held in the storage means is longer than the time for which a part of the toner supplied into the developing unit by the toner supply operation firstly arrives at the toner concentration sensor.

Further, this invention provides the image forming apparatus, characterized in that the time for which the history of the toner supply operation is held in the storage means is longer than an average time length for which the toner supplied into the developing unit by the toner supply operation arrives at the toner concentration sensor, in which the time of the toner supply operation by the toner supply means is determined, based on all the information stored in the storage means and half the information of the stored information.

According to the invention, it is possible to provide an image forming apparatus capable of producing the high quality image, in which the toner concentration within the developing unit is stabilized without employing a complicate control table, irrespective of the printing density.

DETAILED DESCRIPTION OF THE PREFERRED EMBODIMENTS

Figure 1:
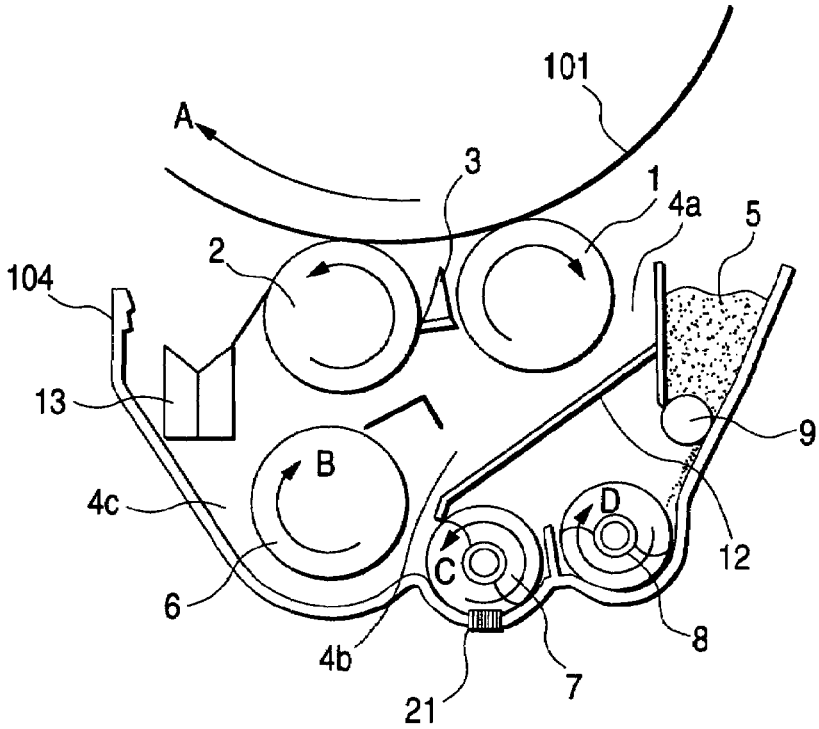
FIG. 1 is a schematic cross-sectional view of a developing unit according to an embodiment of the present invention.
Figure 3:
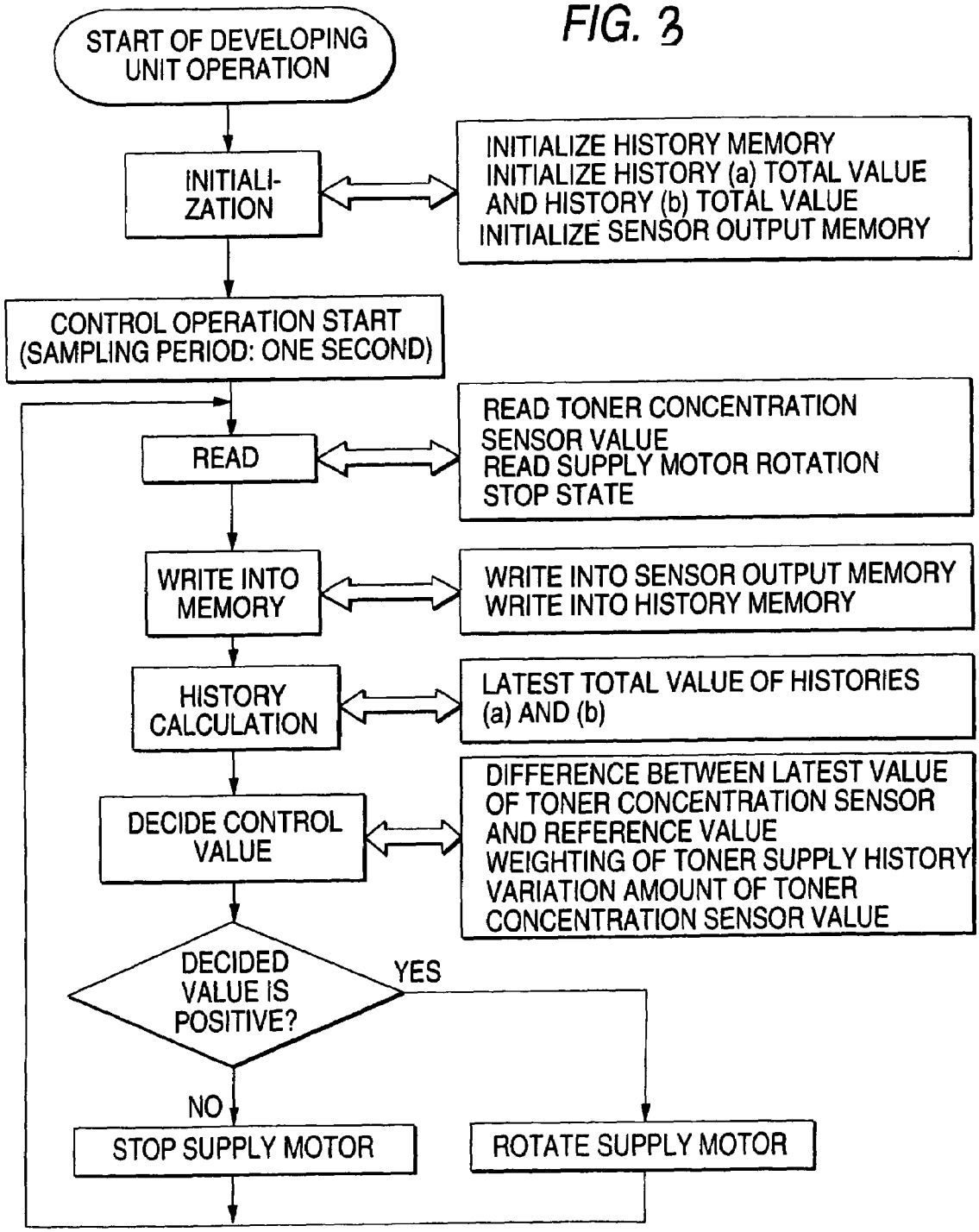
FIG. 3 is a flowchart showing a toner supply control operation according to the embodiment of the invention.

Referring mainly to FIGS. 1 and 3, the preferred embodiments of the present invention will be described below by way of example.

EXAMPLE 1

Figure 2:
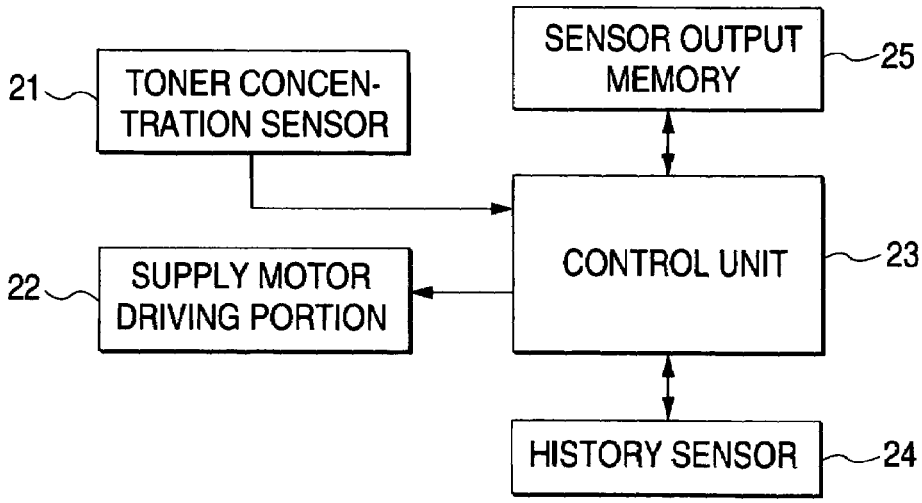
FIG. 2 is a control block diagram of the developing unit according to the embodiment of the invention.

FIG. 1 is a schematic cross-sectional view of a developing unit according to this invention. FIG. 2 is a control block diagram of the developing unit. FIG. 3 is a flowchart showing a toner supply control operation of the developing unit.

In this embodiment, the developing unit 104 comprises two developing rollers 1 and 2 that are opposed to an image carrier called a photoconductor 101. Of the two developing rollers, a developing roller 2 is rotated forwardly with the rotation of the photoconductor 101 as indicated by the arrow A in FIG. 1, and disposed downstream in a rotational direction of the photoconductor 101. Also, a developing roller 1 is rotated reversely with the rotation of the photoconductor 101, and disposed upstream in the rotational direction of the photoconductor 101. Though the developing unit has two developing rollers in this embodiment, another constitution of the developing unit may be taken in which a plurality of developing rollers are provided upstream of the developing roller 1 in the rotational direction of the photoconductor 101, a plurality of developing rollers are provided downstream of the developing roller 2 in the rotational direction of the photoconductor 101, the developing rollers in the forward and reverse rotations are not combined, or a single developing roller is provided, for example. Moreover, in this embodiment, the image carrier employs a drum-like photoconductor, but may employ a photosensitive belt moving around on a specific trajectory.

Also, in the developing unit 104, a partition plate called a doctor blade 3 is interposed between the developing roller 1 and the developing roller 2.

In the embodiment as shown in FIG. 1, a transfer agent called a developer 5 is composed of a magnetic powder called a carrier and an image visualizing agent, called a toner, for forming a visible image on the photoconductor 101, the toner being mixed at a weight ratio of 2 to 8% in total weight. In this embodiment, in the developer 5, the weight ratio of toner in the developer within the developing unit is decreased, because the toner in the developer 5 is only consumed in the printing operation of the image forming apparatus, not shown.

Therefore, in this embodiment, the developing unit 104 comprises the mixing agitating members 7 and 8 for mixing and agitating the toner supplied from a toner supply unit 9 to the developing unit 104 with the developer 5. The mixing agitating members 7 and 8 are helical screws which are rotated in the directions as indicated by the arrow C and D in the figure, and disposed so that the helical directions of the screw members 7 and 8 are opposite to each other in the direction of rotational axis of the screw. Thereby, when the screws are rotated, one screw conveys the developer from the rear to the fore side in the direction of rotational axis, and passes it to the other screw. The other screw conveys the developer from the fore to the rear side in the direction of rotational axis, and passes it to the one screw. With these operations, the developer is moved around in the direction of rotational axis of the screw, agitated and conveyed.

In this embodiment, the toner consumed on the developing rollers in the image forming operation is supplied from the toner supply unit 9 over the entire area of the helical screw 8 away from a conveying member 6. The developer supplied with the new toner is conveyed on the helical screw 8 in the axial direction, and accepted by the helical screw 7 on the side of the conveying member at its end portion. The developer arriving at the helical screw portion 7 on the side of the conveying member is diverted into the helical screw portion 7 in which the developer is further conveyed in the axial direction by the rotation of screw, and into the conveying member 6. Moreover, when the conveying member 6 is rotated in a direction of the arrow B, the developer is conveyed around the conveying member 6 up to the doctor blade 3 near the developing roller 2. Herein, the developer 4 is regulated to a predetermined amount by passing through a regulation gap of the doctor blade 3 with respect to the developing roller 2, and conducted to the position near the developing roller 2 and the photoconductor 101. At this time, the developer regulated through the regulation gap at the doctor blade 3 is further conducted to the developing roller 1, passed through a regulation gap of the doctor blade 3 with respect to the developing roller 1, regulated to a predetermined amount, and conducted to the position near the developing roller 1 and the photoconductor 101. Also, a return developer 4*a* from the developing roller 1 and an excess developer 4*b* on the doctor blade 3 are returned through a return passage 12, a return developer 4*c* is returned from the developing roller 2 through a return passage 13 near the conveying member 6.

Moreover, the portions of the developing rollers 1 and 2 in the neighborhood of the photoconductor 101 are set at a predetermined potential under adjustment, before an image formed portion and a non-image formed portion on the surface of the photoconductor 101 arrive at the developing portion through a charging and exposing process, not shown, in which a developing bias is applied to the developing rollers 1 and 2 from a power source, not shown, so that the toner of the developer on the developing rollers 1 and 2 is only supplied to the image formed portion of the photoconductor 101. Thereby, a visible image of toner is formed on the image formed portion of the photoconductor 101. Thereafter, the visible image on the photoconductor 101 is printed on the paper through a transfer process, not shown, and then fixed on the paper through a fixing process, not shown.

In addition to the above constitution, a toner concentration sensor 21 for sensing the amount of toner in the developer is disposed on a wall face of an axially central bottom portion for the helical screw 7 in this embodiment. The toner concentration sensor 21 is connected to a control unit 23 for controlling the toner supply operation by processing an output signal of the toner concentration sensor 21 to cause a supply motor driving portion 22 of the toner supply unit 9 to rotate or stop a supply motor, as shown in FIG. 2. This control unit 23 comprises a history memory 24 for storing a history of the toner supply operation and a sensor output memory 25 for storing an output value of the toner concentration sensor.

In this embodiment, the output of the toner concentration sensor 21 is sampled at an interval of 10 ms, and an average value of the sensor output for one second in the past is stored in the sensor output memory 25. Also, the toner supply history is sampled at an interval of 1 second, and the value 1 when the supply motor is rotated, or the value 0 when it is stopped, is stored in the toner supply history memory 24. The sensor output memory 25 and the toner supply history memory 24 store the sensor outputs for 4 seconds in the past, and the supply history for 20 seconds in the past, respectively. The oldest data is discarded, and the newest data is taken in.

Also, in this embodiment, among the data held in the toner supply history memory 24, a total value of history for 10 seconds in the past (hereinafter described as a history (a) total value) and a total value of history for 20 seconds in the past (hereinafter described as a history (b) total value) are employed.

Referring to FIG. 3, a flow of the toner concentration control operation in this embodiment will be described below.

If a developing unit operation start signal is sent from the control unit of the image forming apparatus, not shown, to the control unit 23 in FIG. 2, the toner supply history memory 24, the sensor output memory 25, the history (a) total value, and the history (b) total value are initialized. In this case, an area for 20 seconds in the toner supply history memory, the history (a) total value and the history (b) total value are set to zero, and the sensor output value immediately after stating the developing unit operation is stored in all the area for 4 seconds in the sensor output memory 25.

Subsequent to this initialization operation, the control operation is started. First of all, the value of the toner concentration sensor (the average of values sampled at an interval of 10 ms, as previously described) and a rotation stop status are read in, based on a sampling period at an interval of one second, and written as the latest data in the sensor output memory 25 and the history memory 24, respectively. Then, a difference P between the latest value of the toner concentration sensor and the preset reference value T0, data, the history (a) total value l1, the history (b) total value l2, and a difference D between the oldest value and the latest value of the sensor output memory 25 are obtained, based on information written into the respective memories. Thereafter, the values of P, l1, l2, and D are multiplied by the corresponding preset sensitivity values p0, a0, b0 and d0, and summed, whereby the current control value F [=(p0*P)+(a0*l1)+(b0*l2)+(d0*D)] is decided. In this embodiment, the sensitivities p0, a0, b0 and d0 are set to +1, −0.5, +0.25 and +1, respectively. When this control value F is positive, the supply motor starts to be rotated, or continuously rotated if it is during rotation, while when the control value F is negative, the supply motor is stopped, or kept stopped if it is in stopped state. Thereafter, the toner concentration sensor value and the rotation stop status of the supply motor are read in again, and the subsequent operation is repeated.

A concept of deciding the control value will be detailed below. Normally, the toner may be supplied to make up for a difference P between the latest value of the toner concentration sensor and the preset reference value. However, due to a time lag with which the developer supplied with toner arrives at the toner concentration sensing position, it is not possible to judge, only from the current difference P, how the value of the toner concentration sensor will transition in the future. To judge this transition, the history (a) total value l1 is employed. The history (a) is the toner supply history for 10 seconds in the past from the present time, as previously described, and decided based on the time for which the developer supply with toner arrives at the sensor position. In this embodiment, the toner consumed in the image forming operation by the developing rollers is supplied over the entire area in the axial direction on the side of the spiral screw 8 away from the conveying member 6. The value of 10 seconds corresponds to the time for which the front portion of the developer supplied with toner arrives at the sensor position. The history (a) total value 11 imposes a restriction on the present supply amount based on the supply amount of toner to the developer not arriving at the sensor in the past. That is, if the supply amount of toner in the past is greater, the present supply amount is more suppressed. Also, a difference D between the oldest value and the latest value of the sensor output memory 25 is provided to check a change in the toner concentration. If the value of D is positive, the feed amount is increased because the sensor output is changed in a direction away from the reference value, or if the value of D is negative, the feed amount is decreased, because the sensor output is changed in a direction toward the reference value.

In this embodiment, additionally, the history (b) total value l2 is employed. The history (b) total value involves the toner supply history for 20 seconds in the past from the present time, as previously described, and corresponds to a center between the front portion and the trail portion of the developer supplied with toner, or the average time for which the developer supplied with toner arrives at the sensor position. In this embodiment, the toner concentration is sufficiently stabilized under the control only using the P, l1 and D, but by employing the history (b) total value l2, it is possible to correct the tendency that the toner concentration sensor value is stabilized far below the reference value, rather than the control only using P, l1 and D.

In this embodiment, the toner concentration detecting position at which the toner supply operation is performed occurs on the side of the spiral screw 7, but may occur on a round path of developer directly moving around the developing rollers 1, 2 and the conveying member 6, for example, on the return path of the return developer 4*a* from the developing roller 1, or the return path of the return developer 4*c* from the developing roller 2.

Moreover, in this embodiment, the history (a) is the toner supply history for 10 seconds in the past from the present time, and the history (b) is the toner supply history for 20 seconds in the past from the present time, both being the minimum supply histories to be retained, in which the history (a) may be the toner supply history for 20 seconds in the past from the present time, and the history (b) may be the toner supply history for 40 seconds in the past from the present time. In this case, in this embodiment, the history (a) corresponds to the average time for which the developer supplied with toner arrives at the sensor position, and the history (b) corresponds to the time for which the developer supplied with toner makes a round of the mixing agitating members 7 and 8.

Figure 6:
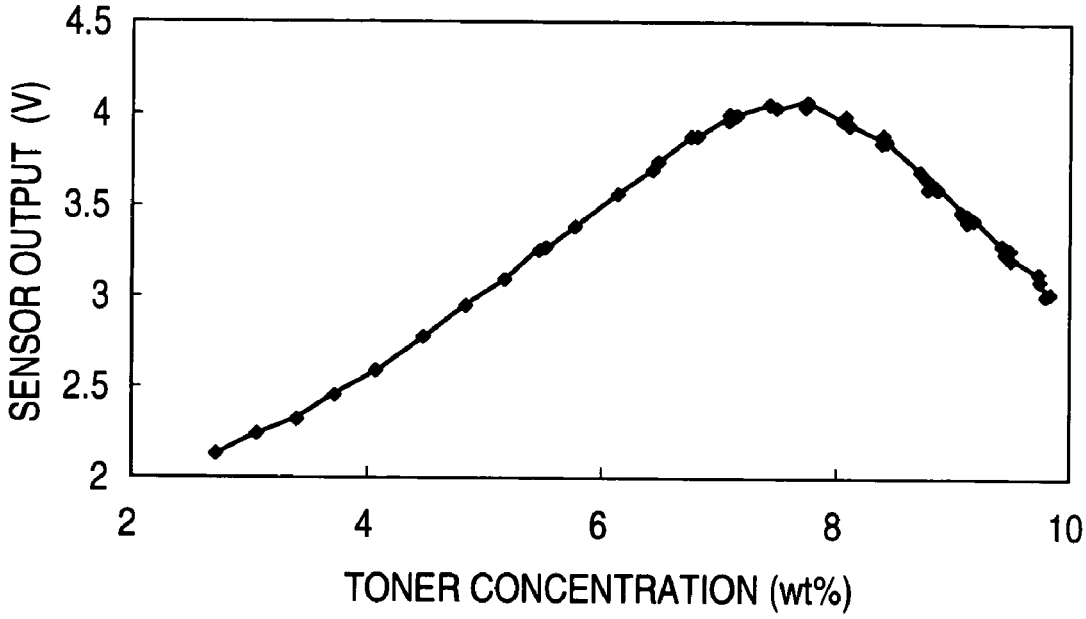
FIG. 6 is a diagram showing the relationship between the toner concentration and the output of the toner concentration sensor according to the embodiment of the invention.
Figure 7:
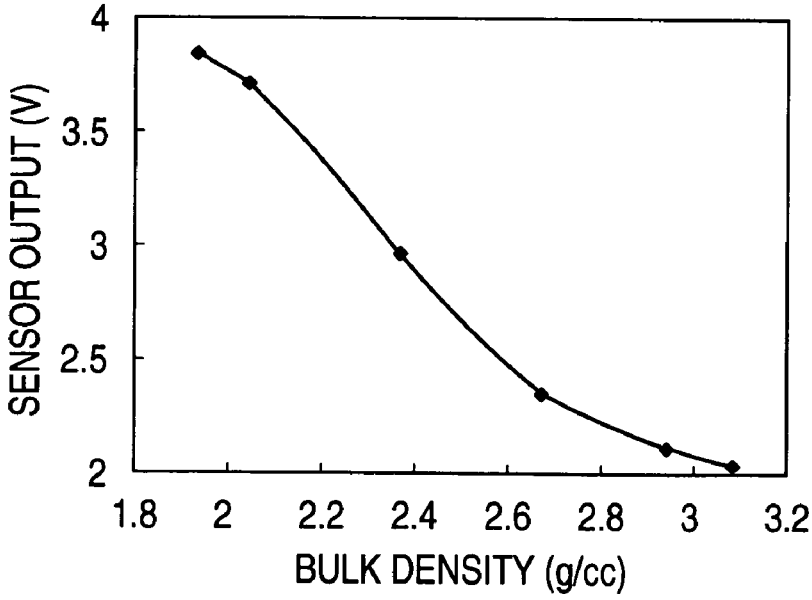
FIG. 7 is a diagram showing the relationship between the bulk density of developer and the output of the toner concentration sensor according to the embodiment of the invention.

FIG. 6 is a graph showing the relationship between the toner concentration and the output of the toner concentration sensor according to the embodiment of the invention. FIG. 7 is a graph showing the relationship between the bulk density of developer and the output of the toner concentration sensor. In the sensor for use in this embodiment, the sensor output is changed according to a carrier weight in a fixed volume, or the bulk density, as shown in FIG. 7. A change in the carrier weight depends on a change in the toner concentration. In this embodiment, when the toner concentration is increased from 3 wt % to 7 wt %, the sensor output is almost linearly increased, but may be changed at will according to the toner concentration value possibly used, for example, linearly changed from 6 wt % to 10 wt %. Moreover, when the toner concentration is increased, the sensor output may be almost linearly decreased. In this case, it is required to adjust the positive and negative of sensitivity.

Figure 4:
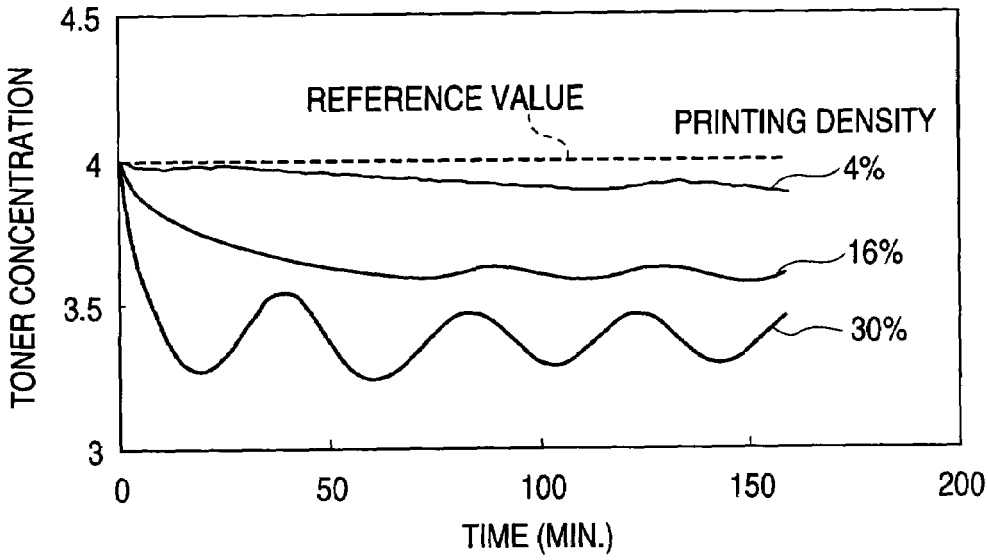
FIG. 4 is a diagram showing a toner concentration control state under the conventional control.
Figure 5:
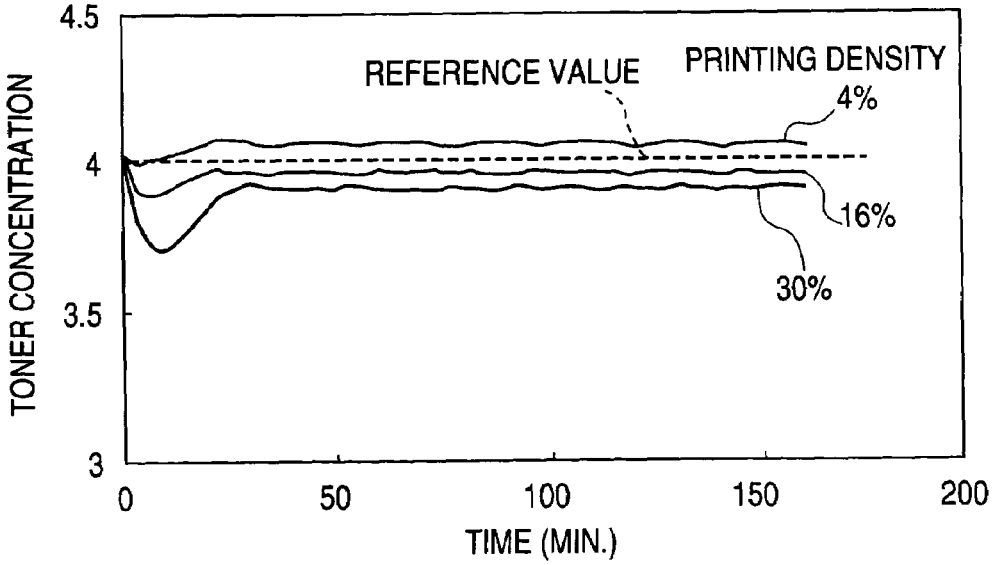
FIG. 5 is a diagram showing a toner concentration control state under the control according to the embodiment of the invention.

For the developing unit having the above constitution, the printing was performed, employing a negatively charged OPC for the photoconductor 101, in which the voltages of the image formed portion and the non-image formed portion on the surface of the photoconductor 101 were −100V and −600V, and the bias voltages of the developing rollers 1 and 2 were equally −400V. At this time, the conditions of the printing operation were such that the peripheral speed of the photoconductor 101 was 100 cm/s, the peripheral speed ratio of the peripheral speed of developing rollers 1 and 2 to that of the photoconductor was 1.3, and the toner weight percentage in the developer was 4 wt %. In this case, the toner concentration control state is presented in contract to the toner concentration control method as described in the prior art. FIG. 4 is a graph showing the toner concentration control state under the conventional control. FIG. 5 is a graph showing the toner concentration control state under the control of the embodiment of the invention.

The toner concentration control method as employed in the prior art involves dividing a deviation amount of toner concentration sensor value from the reference value into several levels, whereby if the sensor value indicates the level where the deviation amount is greater, the toner supply amount is increased.

In the case of this control method, when the continuous printing at a low printing density is performed, there is a small deviation from the reference value at a control reference toner concentration of 4 wt %, but when the continuous printing of the image at a high printing density of 30 wt % is performed, the toner concentration is decreased to the level at which the toner supply amount exceeds the toner consumption amount, and then starts to rise, as shown in FIG. 4. However, when the toner concentration rises, the level is changed, so that the toner supply amount is decreased. Again, the toner concentration is repeatedly decreased and increased, and finally stabilized at a level of about 3.5 wt % that is considerably lower than the toner concentration of reference.

On the other hand, under the control of the embodiment, a deviation from the reference value is smaller at a control reference toner concentration of 4 wt %, irrespective of whether the continuous printing is performed at a low printing density of 4% or a high printing density of 30%, as shown in FIG. 5. Thereby the image forming apparatus for producing the high quality image can be provided.

What is claimed is:

1. An image forming apparatus comprising:

a two-component developing unit;

a toner concentration detector for detecting a toner concentration in a developer held within said developing unit;

a toner supply unit for supplying a toner into said developing unit;

a storage unit for sequentially holding and updating a history of a toner supply operation for a certain period of time; and a toner concentration control unit for determining an amount of time for operation of said toner supply unit based on said history of toner supply operation covering said certain period of time and a difference between an output value of said toner concentration detector and a reference value, and for maintaining a constant toner concentration.

2. The image forming apparatus according to claim 1, wherein the certain period of time, for which the history of the toner supply operation is held in said storage unit, is longer than a period of time that it takes for a part of a toner supplied into said developing unit by the toner supply operation to arrive at said toner concentration sensor.

3. The image forming apparatus according to claim 1, wherein the certain period of time, for which the history of the toner supply operation is held in said storage unit, is longer than an average time length for which the toner supplied into said developing unit by the toner supply operation takes to arrive at said toner concentration sensor, and wherein the amount of time of the toner supply operation by said toner supply unit is determined; based on at least said history covering all of said certain period of time and a history of said toner supply operation coverina one half of said certain period of time.

4. The apparatus of claim 1, wherein said history of toner supply operation comprises a plurality of values each indicating one of an ON condition of a toner supply motor and an OFF condition of said toner supply motor.

5. An image forming apparatus comprising:

a toner concentration detector that detects a concentration of a toner within a two-component developer;

a toner supplier that supplies the toner into said two-component developer;

a toner supply history storage that stores a history of an operation of said toner supplier; and a toner concentration controller that controls said toner supplier based upon said history of said toner supplier operation and the detected concentration of said toner.

6. The apparatus of claim 5, wherein said history comprises a plurality of values sampled over a predetermined period of time.

7. The apparatus of claim 6, wherein each of said plurality of values indicates at least one of an ON condition of said toner supplier and an OFF condition of said toner supplier.

8. The apparatus of claim 6, wherein said plurality of samples are sampled every one second.

9. The apparatus of claim 6, wherein said predetermined period of time comprises four seconds.

10. The apparatus of claim 6, wherein said predetermined period of time comprises twenty seconds.

11. The apparatus of claim 5, wherein said toner concentration controller controls said toner supplier based upon a difference between the detected concentration of said toner and a reference value.

12. An image forming apparatus comprising:

a two-component developing unit;

a toner concentration detector for detecting a toner concentration of developer in said developing unit;

a toner supplier for supplying a toner into said developing unit; and a toner concentration controller for maintaining a constant toner concentration comprising:

a history memory for storing a history of toner supply operation; and a sensor output memory for storing an output value of said toner concentration detector.

13. The image forming apparatus of claim 12, wherein the history memory is further for retaining two histories of toner supply operation that are performed for different periods.

14. The image forming apparatus of claim 12, wherein the history memory stores an amount of toner supply within a period from a time when the developer begins to be supplied with the toner to a time when a front portion of the developer supplied with the toner arrives at a sensor position.

15. The image forming apparatus of claim 12, wherein the sensor output memory stores sensor outputs for four seconds in the past.

16. An image forming apparatus, comprising:

a two-component developing unit;

a toner concentration detector for detecting a toner concentration in a developer within said developing unit;

a toner supply unit for supplying a toner into the developing unit; and a toner concentration controller for maintaining a constant toner concentration, wherein the toner concentration controller comprises:

a history memory for storing a history of a toner supply operation; and a sensor output memory for storing an output value of the toner concentration detector, wherein the toner concentration controller determines an amount of time for operation of said toner supply unit at least based on:

a difference P between an output value of the toner concentration detector and a preset reference value To;

a history (a) total value 11 of the operation of the toner supply unit; and a difference D between an oldest value and a latest value in said sensory output memory.

17. The image forming apparatus of claim 16, wherein the history memory stores an amount of toner supply within a time for which a front portion of the developer supplied with the toner arrives at a sensor position.

18. The image forming apparatus of claim 16, wherein the history memory stores an amount of toner supply within a time for which a front portion of the developer arrives at a sensor position, and stores an amount of toner supply within a time for which a center between a front portion and a trail portion of the developer supplied with the toner arrives at the sensor position.

19. The image forming apparatus of claim 16, wherein the history memory stores one of a state in which a toner supply motor is powered on and a state in which the toner supply motor is powered off.

* * * * *